US006602363B2

(12) United States Patent
Ren

(10) Patent No.: US 6,602,363 B2
(45) Date of Patent: Aug. 5, 2003

(54) ALUMINUM ALLOY WITH INTERGRANULAR CORROSION RESISTANCE AND METHODS OF MAKING AND USE

(75) Inventor: Baolute Ren, Murrysville, PA (US)

(73) Assignee: Alcoa Inc., Pittsburgh, PA (US)

( * ) Notice: Subject to any disclaimer, the term of this patent is extended or adjusted under 35 U.S.C. 154(b) by 38 days.

(21) Appl. No.: 09/840,576

(22) Filed: Apr. 23, 2001

(65) Prior Publication Data

US 2001/0032688 A1 Oct. 25, 2001

Related U.S. Application Data

(63) Continuation-in-part of application No. 09/616,015, filed on Jul. 13, 2000, now Pat. No. 6,503,446, and a continuation-in-part of application No. 09/564,053, filed on May 3, 2000, now Pat. No. 6,458,224.

(60) Provisional application No. 60/171,598, filed on Dec. 23, 1999.

(51) Int. Cl.[7] ..... C22C 21/00

(52) U.S. Cl. ..... 148/437; 420/549; 420/551; 420/553

(58) Field of Search ..... 148/437; 420/549, 420/551, 553

(56) References Cited

U.S. PATENT DOCUMENTS

| | | | |
|---|---|---|---|
| 3,878,871 | A | 4/1975 | Anthony et al. |
| 4,039,298 | A | 8/1977 | Anthony et al. |
| 4,093,782 | A | 6/1978 | Anthony et al. |
| 4,339,510 | A | 7/1982 | Kaifu et al. |
| 4,649,087 | A | 3/1987 | Scott et al. |
| 4,749,627 | A | 6/1988 | Ishikawa et al. |
| 4,828,794 | A | 5/1989 | Scott et al. |
| 5,125,452 | A | 6/1992 | Yamauchi et al. |
| 5,286,316 | A | 2/1994 | Wade |
| 5,503,690 | A | 4/1996 | Wade et al. |
| 5,906,689 | A | 5/1999 | Sircar |
| 5,976,278 | A | 11/1999 | Sircar |
| 6,065,534 | A | 5/2000 | Sircar ..... 165/178 |

FOREIGN PATENT DOCUMENTS

| | | |
|---|---|---|
| EP | 0893512 | 1/1999 |
| EP | 0899350 | 3/1999 |
| JP | 57203743 | 12/1982 |
| JP | 5125472 | 5/1993 |
| JP | 5148572 | 6/1993 |
| JP | 5263172 | 10/1993 |
| JP | 5271833 | 10/1993 |
| JP | 5320798 | 12/1993 |
| JP | 6212371 | 8/1994 |
| WO | WO 91/14794 | 10/1991 |
| WO | WO 93/20253 | 10/1993 |
| WO | 97/46726 | 12/1997 |
| WO | WO 99/04050 | 1/1999 |
| WO | WO 99/04051 | 1/1999 |

OTHER PUBLICATIONS

"Metals Handbook: Desk Edition", ASM International, 1998, pp 426–430.*

(List continued on next page.)

*Primary Examiner*—Roy King
*Assistant Examiner*—Janelle Combs Morillo
(74) *Attorney, Agent, or Firm*—Christopher W. Brody; David W. Pearce-Smith

(57) ABSTRACT

A corrosion resistant aluminum alloy has controlled amounts of iron, manganese, chromium, and titanium along with levels of copper, silicon, nickel, and no more than impurity levels of zinc. The alloy chemistry is tailored such that the electrolytic potential of the grain boundaries matches the alloy matrix material to reduce intergranular corrosion. The alloy is particularly suited for the manufacture of tubing for heat exchangers using extrusion and brazing techniques.

8 Claims, 3 Drawing Sheets

OTHER PUBLICATIONS

"Standard Proctice for Modified Salt Spray (Fog) Testing", American Society for Testing and Materials, Designation: G 85–94, pp. 350–355, Apr. 1994.

J.R. Galvele et al., "Mechanism of Intergranular corrosion of A1–Cu Alloys", pp. 795–807, presented at the 4th International Congress on Metallic Corrosion, Amsterdam, Sep. 7–14, 1969.

Ahmed, "Designing of an Optimum Aluminum Alloy for De–salination Applications", pp. 255–261, Strength of Metals and Alloys, vol. 1, Proceeding of the 6th International Conference, Melbourne, Australia, Aug. 16–20, 1982.

I.L. Muller et al., Pitting Potential of High Purity Binary Aluminum Alloys—1; pp. 180–183, 186–193, 1977.

* cited by examiner

Figure 1. Galvanic current density of Zn-Ti alloy tube with different fin stock in SWAAT solution.

Figure 2. Galvanic current density of Cr-Ti alloy tube with different fin stock in SWAAT solution.

ALUMINUM ALLOY WITH INTERGRANULAR CORROSION RESISTANCE AND METHODS OF MAKING AND USE

This application is a continuation-in-part of application Ser. No. 09/564,053 filed on May 3, 2000 now U.S. Pat. No. 6,458,224, which is based on provisional application No. 60/171,598 filed on Dec. 23, 1999, and a CIP of application Ser. No. 09/616,015 filed on Jul. 13, 2000, now U.S. Pat. No. 6,503,446 all incorporated by reference in their entirety.

FIELD OF THE INVENTION

The present invention is directed to an aluminum alloy and its methods of making and use, and especially to an aluminum alloy having controlled amounts of iron, manganese, chromium, and titanium and controlled levels of zinc for corrosion resistance, particularly resistance to intergranular corrosion.

BACKGROUND ART

In the prior art, a number of corrosion resistant aluminum alloys have been developed for use in round and flat tubing applications such as heat exchangers, especially condensers. Some of these alloys are described in U.S. Pat. Nos. 5,906,689 and 5,976,278, both to Sircar, each herein incorporated in their entirety by reference.

U.S. Pat. No. 5,906,689 (the '689 patent) discloses an aluminum alloy employing amounts of manganese, titanium, low levels of copper, and zinc.

U.S. Pat. No. 5,976,278 (the '278 patent) discloses an aluminum alloy having controlled amounts of manganese, zirconium, zinc, low levels of copper, and titanium. The '278 patent differs in several aspects from the '689 patent, including exemplifying higher levels of manganese, and the use of zirconium.

Both of these patents are designed to produce corrosion resistant aluminum alloys via chemistry control. One reason for better corrosion resistance in the alloy of the '689 patent is reducing the amount of the intermetallic $Fe_3Al$, as is found in prior art alloys such as AA3102. However, while corrosion is improved, this alloy has a reduced number of intermetallics, and can lack the necessary formability in certain applications, e.g., in the manufacture of heat exchanger assemblies.

The alloys of the '278 patent can also lack formability in certain instances as a result of the presence of needle-like intermetallics that are generally $MnAl_6$.

In response to these shortcomings, improved aluminum alloys have been proposed in application Ser. No. 09/564,053 filed on May 3, 2000 now U.S. Pat. No. 6,458,224, which is based on provisional application No. 60/171,598 filed on Dec. 23, 1999, and application Ser. No. 09/616,015 filed on Jul. 13, 2000 now U.S. Pat. No. 6,503,446. In these improved alloys, the distribution of intermetallics is improved and the intermetallic particle chemistry is controlled for improved formability, corrosion resistance, hot workability, and brazeability. These alloys also exhibit a fine grain structure in the worked product, particularly in alloys employing thin wall structures such as flat or multivoid tubing. By increasing the number of grains via a fine grain size, the grain path becomes more tortuous, and corrosion along the grain boundary is impeded.

However, these improved aluminum alloys still have shortcomings in terms of increased die wear and increased working pressures. In certain applications, the alloys exhibit high flow stresses, extrusion becomes more difficult, and extrusion die wear is increased.

While these improved aluminum alloys do exhibit excellent corrosion resistance under SWAAT conditions, intergranular corrosion at the grain boundaries is still a predominant corrosion mechanism, and corrosion can be a problem in spite of the preferred intermetallic particle chemistry, and fine grain size. Intergranular corrosion can be particularly troublesome once the tubing is brazed together with fin stock in a condenser assembly or the like. First, the assembly of the tubing and fin stock can create a galvanic cell due to the potential difference between the fin stock of one composition and the tubing having another composition, and galvanic corrosion can occur. Second, the corrosion potential difference between certain fin stocks and the tubing can be significant, and in these instances, a tubing that is particularly susceptible to intergranular corrosion can quickly degrade. Such degradation can result in premature failure of the assembled device. This problem can be especially troublesome when tubing is thin walled tubing, e.g., micro-multivoid condenser tubing. With thin wall thicknesses and an intergranular corrosion mechanism, galvanic corrosion along the grain boundaries, can compromise the wall integrity to the point wherein the tubing fails, and the entire condenser assembly must be replaced.

Another problem with these improved alloys is that in some instances, the worked or extruded product must be further cold worked or stretched to meet product dimensional limitations. This added cold work imparts a higher stored energy in the matrix of the material, and this extra energy manifests itself as enlarged grains during a subsequent brazing cycle. Consequently, even though these materials are designed to have a fine grain size to control intergranular corrosion, producing a fine grain size in the pre-brazed product does not always assure that the material will have adequate corrosion protection in its final assembled state.

In light of these problems, a need exists to provide aluminum alloys with improved corrosion resistance and less sensitivity to grain size. The present invention solves this need by providing an aluminum alloy that employs controlled amounts of iron, manganese, chromium, and titanium whereby the electrolytic potential of the grain boundaries fairly matches that of the matrix material, and preferential corrosion along the grain boundaries is minimized. This matching of potentials affords strong protection in situations even where galvanic corrosion is present, i.e., the grain boundaries do not corrode preferentially with respect to the matrix material, and the material corrodes in a more homogenous manner.

SUMMARY OF THE INVENTION

It is a first object of the present invention to provide an improved aluminum alloy that exhibits excellent corrosion resistance, does not have intergranular corrosion as its principle corrosion mechanism, and is less sensitive to fine grain size requirements for corrosion control.

Another object of the invention is to provide an aluminum alloy utilizing controlled amounts or levels of iron, manganese, chromium, zinc, and titanium.

One other object of the invention is a method of using the aluminum alloys as components in brazing applications, whereby the similar electrochemical potentials of the matrix and grain boundaries of the components minimize corrosion along the grain boundaries, particularly in situations where galvanic corrosion may be present. The components can be sheet, tubing, or the like.

Yet another object of the invention is a method of making an aluminum alloy wherein a ratio of manganese to iron, a ratio of chromium to titanium, and zinc levels are controlled during the making step to reduce the susceptibility of the alloy to corrosion along the grain boundaries when put in use.

Other objects and advantages of the present invention will become apparent as a description thereof proceeds.

In satisfaction of the foregoing objects and advantages, the present invention is an improvement in long life aluminum alloys using low levels of copper, and manganese, iron, zinc, titanium, and zirconium as alloying elements for corrosion resistance, brazeability, formability, and hot workability. The inventive aluminum alloy consists essentially of, in weight percent:

between about 0.05 and 0.5% silicon;

an amount of iron between about 0.05% and up to 1.0%;

an amount of manganese up to about 2.0%;

less than 0.1% zinc;

up to about 0.10% magnesium;

up to about 0.10% nickel;

up to about 0.5% copper;

between about 0.03 and 0.50% chromium;

between about 0.03 and 0.35% titanium;

with the balance aluminum and inevitable impurities;

wherein the manganese to iron ratio is maintained between about 2.0 and about 6.0, and the amounts of chromium and titanium are controlled so that a ratio of chromium to titanium ranges between 0.25 and 2.0.

In more preferred embodiments, the alloy composition can vary in terms of the amounts of manganese, iron, chromium, titanium, levels of copper and zinc as follows:

The titanium amount can range between about 0.06 and 0.30%, more preferably between about 0.08 and 0.25%. The chromium amount ranges between about 0.06 and 0.30%, more preferably between about 0.08 and 0.25%. The zinc levels can be less than 0.06%, and the ratio of chromium to titanium can range between about 0.5 and 1.5.

The invention also entails the use of the alloy in brazing applications, particularly as part of the manufacture of heat exchanger assemblies. The alloy is particularly effective in assemblies wherein the alloy is employed as tubing, either round, flat or the like, and is brazed to dissimilar materials such as fin stock, headers, or other heat exchanger components.

In making the alloy, the composition is controlled so that each of the manganese to iron amounts and the chromium and titanium amounts are adjusted within the claimed ratios.

The alloy composition can be made into any article using conventional processing of casting, homogenizing, hot/cold working, heat treating, aging, finishing operations and the like. The articles can be used in combination with other articles or components as well.

BRIEF DESCRIPTION OF THE DRAWINGS

Reference is now made to the drawings of the invention wherein.

DESCRIPTION OF THE PREFERRED EMBODIMENTS

Figure 1:
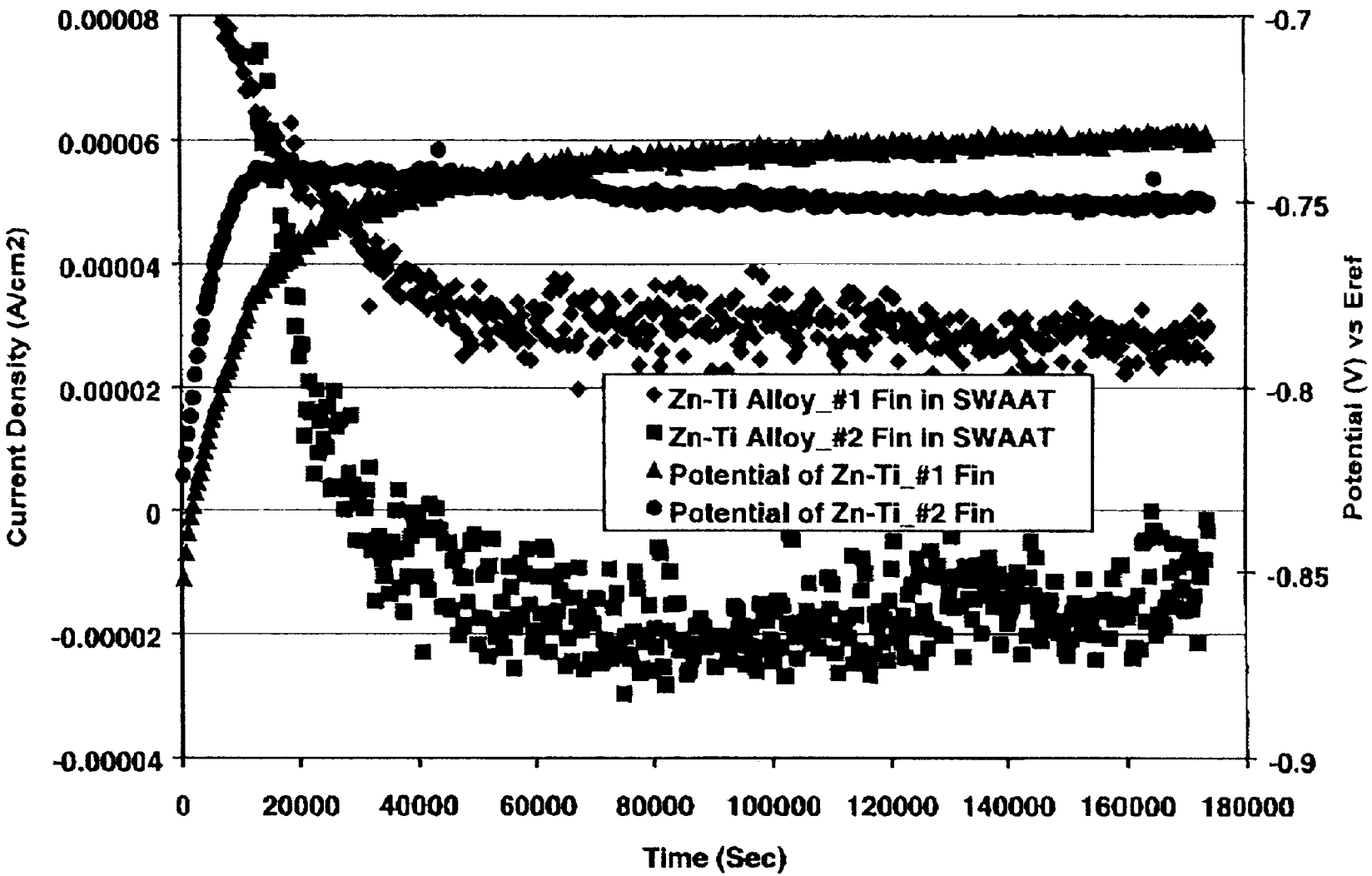
FIG. 1 is a graph comparing current density versus time and potential versus time for an aluminum alloy composition having zinc and titanium and different fin stocks.

The present invention offers significant advantages in the field of corrosion resistant aluminum alloys, particularly those used to make tubing, both round and flat, for heat exchanger applications such as those used in vehicles, e.g., condensers, and other uses, e.g., air conditioners, refrigerators, and the like.

The present invention deviates from prior art techniques that controlled intermetallic chemistry and sought fine grain sizes to inhibit corrosion resistance. The inventive alloys utilize amounts and ratios of alloying elements to match the electrochemical potential of the alloy matrix and the grain boundaries. By specifying/controlling the alloying element amounts and ratio, a balance can be maintained between the electrochemical potential of the matrix and the grain boundaries, i.e., the difference between the corrosion potential of the grain boundaries and the matrix is minimized. With such a balance, local cell action at the grain boundaries is either not activated, or the activation is significantly reduced or minimized. This matching of potentials significantly improves the life performance of the tubing when assembled in devices that inherently expose the tubing to an environment that is conducive to corrosion, and is particularly effective against environments where galvanic corrosion may be a problem. The invention also reduces the need for having a fine grain size and the right particle chemistry in the alloy as is the case in prior art alloys.

Another feature of the invention is that control of the corrosion potential of the grain boundaries and matrix lessens the sensitivity of the material to grain size and the requirement of a certain percentage of intermetallics. That is, since the intergranular attack at the grain boundaries is significantly reduced or eliminated, the material can have a larger grain size without losing corrosion resistance. This tolerance for a larger grain size is significant in applications where a finished material may be subjected to a further cold working, e.g., stretching. In such processes, even though the grain size will increase as a result of stretching, the alloy resists localized corrosion at the grain boundaries; instead corroding in a more general or homogenous fashion. By lessening the need to have a fine grain size, the corollary of having a number of fine intermetallics to control the grain size during processing and/or manufacturing conditions, e.g., extrusion or brazing cycles, is also less critical. Consequently, controlling the alloy composition according to the invention offers not only significant improvements in corrosion, but also eases the control of grain size and chemistry necessary for prior art alloys. Consequently, the alloy is more user friendly to manufacture, particularly as articles such as tubing for use in assemblies such as heat exchangers.

The invention is an improvement over the compositions detailed in U.S. Pat. Nos. 6,458,224 and 6,503,446. The inventive aluminum alloy is an improvement in that the zinc, chromium and titanium levels are now controlled in conjunction with the control of the manganese and iron ratio as disclosed in U.S. Pat. No. 6,458,244.

The alloy of the instant invention consists essentially of, in weight percent, between about 0.05 and 0.5% silicon;

an amount of iron between about 0.05% and up to 1.0%;

an amount of manganese up to about 2.0%;

less than about 0.1% zinc;, i.e., at an impurity level;

up to about 0.10% magnesium;

up to about 0.10% nickel;

up to about 0.5% copper;

between about 0.03 and 0.50% chromium;

between about 0.03 and 0.35% titanium;

with the balance aluminum and inevitable impurities; wherein the manganese to iron ratio is maintained between about 2.0 and about 6.0, and the amounts of chromium and titanium are controlled so that a ratio of chromium to titanium ranges between 0.25 and 2.0.

More preferred ratios for chromium to titanium range from 0.5 to 1.5, even more preferred being 0.8 to 1.2.

In terms of the chromium and titanium weight percent amounts, preferred ranges of titanium include from between about 0.06 and 0.30%, more preferred 0.08 to 0.25%, and even more preferred 0.10 to 0.20%. Similarly, the chromium preferred ranges are between about 0.06 and 0.30%, more preferred 0.08 and 0.25%, and even more preferred about 0.10 and 0.20%. The amounts of chromium and titanium are adjusted to meet the ratios specified above.

Other preferences include specifying the lower range of the Mn/Fe ratio to be between about 2.25, and even 2.5.

The upper range of the Mn/Fe ratio can range from the 6.0 noted above to a preferred upper limit of 5.0, a more preferred upper limit of 4.0, and an even more preferred limit of about 3.0.

In terms of the amounts of manganese and iron in weight percent, a preferred upper limit of iron includes about 0.7%, more preferably about 0.5%, even more preferred about 0.4%, 0.3%, and 0.2%. In a preferred mode, the iron and manganese amounts together total more than about 0.30%.

Likewise, the manganese preferred upper limits range from the 2.0% mentioned above to more preferred values of about 1.5%, even more preferred 1.0%, and still more preferred values of about 0.75%, yet even 0.7%, 0.6%, 0.5%, and even greater than 0.4%.

A preferred lower limit of iron is 0.10%. A preferred lower limit of manganese is about 0.5%.

Another preferred range for iron is between about 0.07 and 0.3%, with a range of manganese being between about 0.5 and 1.0%.

The amount of zinc is considered to be an impurity amount; zinc is not employed in any effective levels when controlling the chromium and titanium. An impurity amount is set at about 0.10%, but the level of zinc may be more tightly controlled to levels less than 0.08%, less than 0.06%, and even less than 0.05%, e.g., 0.02 or 0.03%. The invention in this regard differs significantly from prior art alloys that believed that zinc was an important actor in contributing to the overall properties of these long life alloys. As will be shown below, the presence of zinc can be effective in controlling corrosion in conditions similar to those found in SWAAT testing. However, it is believed that the presence of zinc contributes to intergranular corrosion in these zinc-containing alloys, and corrosion along the grain boundaries can still result in accelerated corrosion rates under the right conditions, e.g., galvanic corrosion.

With the control of iron, manganese, chromium, and titanium, the alloy is more forgiving in terms of the copper amount. That is, in prior art alloys, it was believed that copper levels should be minimized. However, by altering the primary corrosion mechanism from an intergranular one to one that affects both the matrix and grain boundaries in a similar fashion, the copper levels can be up to 0.5%, more preferably up to 0.35%, up to 0.20%, up to 0.1, up to 0.05%. The goal is to ensure that the copper content is such that the copper present in the alloy is in solution rather than in an amount that may cause the copper to precipitate (copper-containing intermetallics are undesirable for corrosion resistance.)

The invention also entails making articles using the inventive alloy composition by melting and casting techniques as are known in the art. During the melting and/or casting, the alloy composition is controlled so that the proper amounts and ratios of manganese and iron and chromium and titanium are achieved. The levels of zinc as detailed above are also controlled. Once the proper alloy is melted and cast, the cast shape can then be processed into an article or assembly using conventional processing techniques.

One preferred use of the inventive composition is processing the aluminum alloy into tubing for heat exchanger application. This tubing is often made by extruding a cast and/or worked shape such as a billet. The billet is subjected to the appropriate heating for extrusion, and is heat treated and/or quenched/aged in the appropriate way depending on the desired end properties. The tubing can then be assembled with other components, e.g., headers, fin stock and the like and subjected to a brazing cycle to interconnect the various pieces together as a unitary assembly.

The inventive alloy is particularly desirable when it is assembled with other materials that may give rise to galvanic corrosion effects. In this mode, the inventive alloy whether as tubing, round or flat, or sheet or other shaped product, corrodes in a more homogeneous fashion that prior art articles whose chemistry is susceptible to intergranular corrosion. For example, the fin stock that is brazed to the tubing in a heat exchanger assembly may create a galvanic cell under certain corrosive conditions with the tubing. By employing an alloy chemistry that reduces or eliminates the potential difference between the grain boundaries and the matrix, intergranular corrosion effects are significantly reduced, and the alloy corrodes in a general or homogenous fashion. This homogenous corrosion results in overall deterioration of the material surface, and rapid and localized corrosion along a grain boundary and subsequent tubing failure is avoided.

While the inventive alloy is preferably utilized in extrusion processes that make tubing, particularly, extrusion processes designed to make heat exchanger tubing, the alloy can also be made into sheet product or other forms and used in applications where formability is important.

In conjunction with the invention, investigative studies were performed on a number of aluminum alloys, with a focus on the problem of intergranular corrosion. Table 1 shows elements of a number of experimental materials. Only the elements of iron, manganese, chromium, zinc, and titanium are shown since these elements are considered to be those elements affecting the properties of the aluminum alloy for the intended applications. The other elements such as silicon, copper, nickel, impurities and the balance of aluminum fall within the ranges disclosed above.

TABLE 1

Composition of experimental materials*

| Alloy | Fe | Mn | Cr | Zn | Ti |
|---|---|---|---|---|---|
| 1 | 0.54 | 0.01 | 0.005 | 0.02 | 0.01 |
| 2 | 0.21 | 0.70 | 0.001 | 0.02 | 0.02 |
| 3 | 0.21 | 0.71 | 0.001 | 0.02 | 0.17 |
| 4 | 0.20 | 0.70 | 0.001 | 0.18 | 0.03 |
| 5 | 0.13 | 0.52 | 0.11 | 0.03 | 0.02 |
| 6 | 0.14 | 0.53 | 0.12 | 0.32 | 0.03 |
| 7 | 0.16 | 0.59 | 0.001 | 0.17 | 0.12 |
| 8 | 0.16 | 0.60 | 0.001 | 0.17 | 0.15 |
| 9 | 0.14 | 0.52 | 0.11 | 0.03 | 0.10 |
| 10 | 0.15 | 0.53 | 0.11 | 0.31 | 0.10 |
| 11 | 0.19 | 0.68 | 0.005 | 0.18 | 0.14 |
| 12 | 0.24 | 0.68 | 0.001 | 0.16 | 0.15 |

*The alloy composition does not disclose the levels of silicon, copper, nickel, the balance of aluminum or other impurities.

TABLE 2

Corrosion results (number of samples passed SWAAT)*

| Alloy | 20 Day | 30 Day | 40 Day |
|---|---|---|---|
| 1 | 0 | 0 | 0 |
| 2 | 5 | 1 | 1 |
| 3 | 5 | 4 | 3 |
| 4 | 5 | 5 | 3 |
| 5 | 5 | 4 | 3 |
| 6 | 1 | 0 | 0 |
| 7 | 5 | 5 | 1 |
| 8 | 5 | 5 | 5 |
| 9 | 5 | 4 | 5 |
| 10 | 5 | 5 | 3 |
| 11 | 5 | 5 | 4 |
| 12 | 5 | 5 | 4 |

*SWAAT was performed according to ASTM G85 A3. Samples were pressure tested at 20 psi following each exposure period.

The alloying element amounts vary in Alloys 1–12 of Table 1. For example, Alloy 1 differs from Alloys 2–12 in terms of the manganese to iron ratio, with Alloy 1 representing a typical AA1100 alloy. Alloy 1 has high iron and low manganese to produce a low Mn/Fe ratio, whereas Alloys 2–12 have lower iron and higher manganese for a higher Mn/Fe ratio. For example, Alloy 2 has an Mn/Fe ratio of 3.3. The Mn/Fe ratio is generally maintained the same for Alloys 2–12 (roughly between 3.0 and 4.0) and is not restated below for Alloys 3–12. The changes in amounts of chromium, zinc, and titanium for Table 1 and listed below are based on the levels found in Alloy 1, which is essentially chromium-, zinc-, and titanium-free. That is, an alloy that would be similar to Alloy 1 but with an addition of chromium would be described as having an amount of chromium. The following describes the presence of alloying elements in terms of each of Alloys 1–12.

1) Low manganese to iron ratio, no chromium, no zinc, and no titanium.
2) High manganese to iron ratio, with roughly the same impurity levels of chromium, zinc, and titanium as Alloy 1.
3) No chromium, no zinc, an amount of titanium.
4) No chromium, an amount of zinc, no titanium.
5) An amount of chromium, no zinc, no titanium.
6) An amount of chromium, an amount of zinc, no titanium.
7) No chromium, an amount of zinc, and an amount of titanium.
8) Similar to Alloy 7, no chromium, amounts of zinc and titanium, with titanium slightly higher than Alloy 7.
9) An amount of chromium, no zinc, an amount of titanium.
10) An amount of chromium, an amount of zinc, an amount of titanium.
11) No chromium, amounts of zinc and titanium.
12) Similar to Alloy 11, no chromium, amounts of zinc and titanium.

Each of Alloys 1–12 was subjected to SWAAT corrosion testing according to ASTM G85 A3. Since this corrosion testing procedure is well known, a further description of its particulars is not believed necessary for understanding of the invention. The results of the testing for different time periods, e.g., 20, 30, and 40 days are shown in Table 2.

First, Table 2 makes it apparent that alloys having a low Mn/Fe ratio do not provide acceptable corrosion resistance. Alloy 1 exhibits totally unacceptable SWAAT testing results. This is due to the fact that the intermetallics are primarily FeAl3, these intermetallics exacerbating corrosion due to their electrolytic potential difference with respect to the aluminum matrix.

Other conclusions apparent from Table 2 come from comparing the alloys in terms of the presence or absence of the elements of chromium, zinc, and titanium. Alloy 2, lacking chromium, zinc, and titanium, provides poor corrosion resistance.

Each of Alloys 3, 4, and 5 uses only one of chromium, zinc, and titanium. Looking at the number of passes for 40 days, having only chromium (Alloy 5), or only zinc (Alloy 4), or titanium (Alloy 3) produced marginal corrosion resistance, i.e., only 3 of 5 passing. This indicates that any one of these elements alone do not provide optimum corrosion resistance.

Alloy 6 is similar to Alloy 5 but also contains zinc. SWAAT testing shows that this combination is particularly poor in corrosion resistance. That is, while chromium in Alloy 5 gave marginal results, adding zinc produced a significant loss in corrosion resistance, and it is clear that zinc is a bad actor when using the preferred ratio of Mn/Fe and chromium.

Alloy 7 having only zinc and titanium also has poor corrosion resistance; only one test specimen passing after 40 days of testing.

Alloy 8 shows that increased levels of titanium over that in Alloy 7 enhance corrosion resistance. However, it should be noted that Alloys 7 and 8 are representative of the prior art thinking in the use of zinc as an alloying element. As will be explained below, while Alloy 8 shows good corrosion resistance in SWAAT testing, an intergranular corrosion mechanism is predominant, and the alloy can still exhibit poor corrosion resistance under conditions of galvanic corrosion. Consequently, this type of a composition does not afford consistent corrosion resistance under all conditions.

Alloy 9 employs chromium and titanium but no zinc, with Alloy 10 being similar to Alloy 9 but with zinc. Comparing Alloys 9 and 10, it is evident that having chromium and titanium but no zinc provides excellent corrosion resistance under SWAAT conditions. The detrimental effect of zinc for Alloy 10 is consistent with the effect of zinc in Alloy 6. More importantly, as shown in the micrographs below, Alloy 9 exhibits a homogenous corrosion behavior, which contrasts greatly with the prior art alloys, e.g., Alloys 7 and 8, exhibiting an intergranular corrosion mechanism.

Alloys 11 and 12 are similar to Alloys 7 and 8 in that they exhibit good corrosion resistance under SWAAT testing. Again though, by using zinc and titanium, these Alloys exhibit an intergranular corrosion mechanism, and do not perform as well when subjected to galvanic corrosion.

Figure 2:
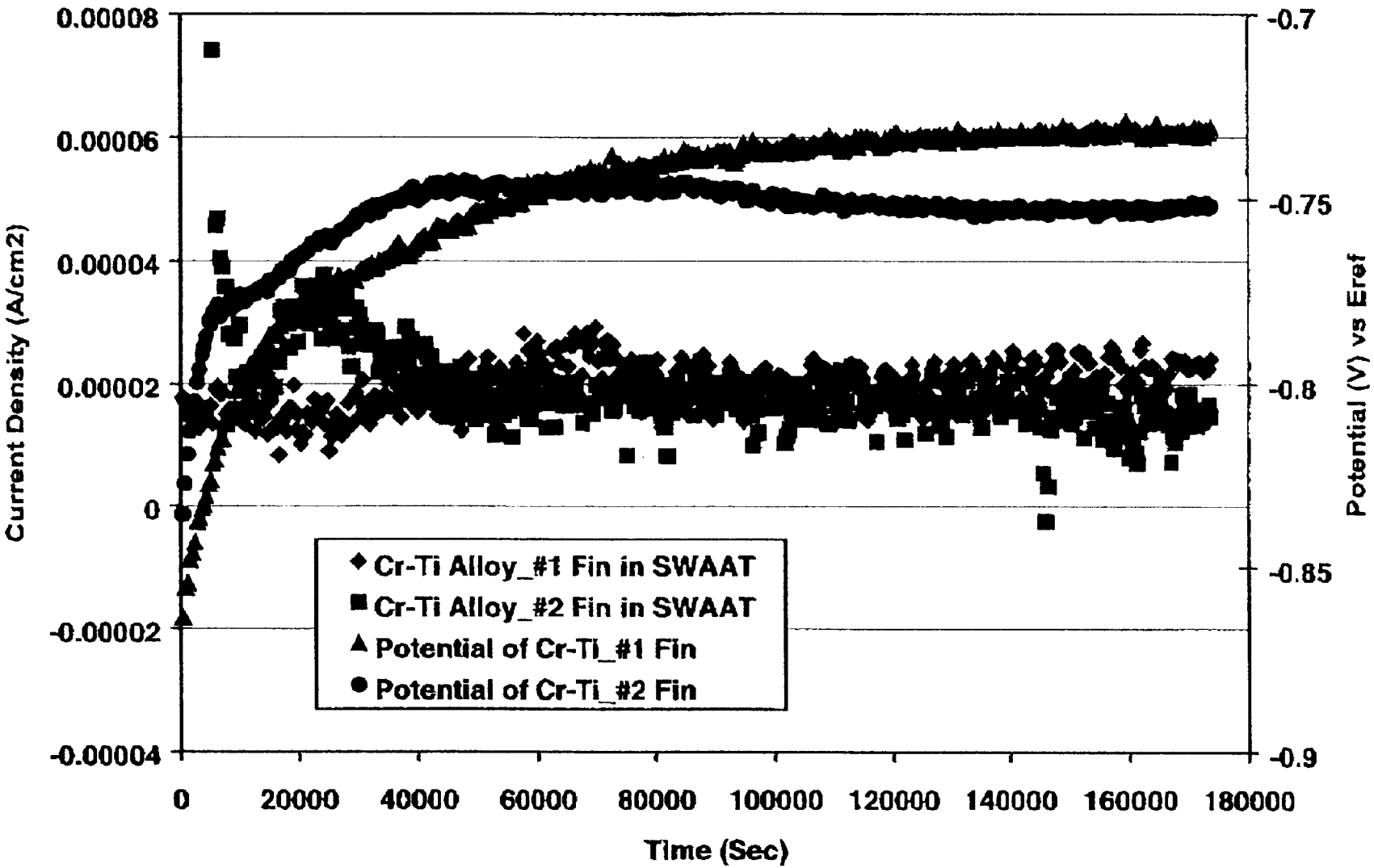
FIG. 2 is a graph comparing current density versus time and potential versus time for an aluminum alloy composition having chromium and titanium and different fin stocks.

Referring now to FIGS. 1 and 2, and Alloys 7–12, studies were conducted investigating the effects on intergranular corrosion when altering compositions in terms of zinc and chromium. FIG. 1 shows the sensitivity of the aluminum alloy containing levels of zinc and titanium when in the presence of fin stock. When the zinc- and titanium-containing aluminum alloy is coupled with one fin stock material, small galvanic current density exists, and the combination of the two has good corrosion resistance and corrosion is minimal. However, when another fin stock material is coupled with the zinc- and titanium-containing aluminum alloy, large current densities are generated, and corrosion resistance is not good. Further, since the zinc and titanium-containing aluminum alloy corrode primarily at the grain boundaries, corrosion is especially bad in thin-walled tubing applications. The Zn—Ti aluminum alloys of FIG. 1 are similar to Alloys 7, 8, 11, and 12 of Tables 1 and 2.

FIG. 2 demonstrates the discovery of the critical aspect of minimizing zinc, while at the same time having sufficient chromium and titanium, as well as the proper amounts of iron and manganese in the aluminum alloy. This Figure employs an aluminum alloy having chromium and titanium rather than zinc and titanium as used in FIG. 1. FIG. 2 clearly shows that the galvanic current generated between the tubing using chromium and titanium and either type of fin stock is almost the same. While corrosion still occurs with the chromium- and titanium-containing aluminum alloy, the corrosion occurs in a much more homogenous manner, not intergranularly as is the case with the Zn—Ti aluminum alloys of FIG. 1. Because of the more homogenous corrosion, the failures of heat exchanger assemblies due to corrosion through the wall thickness of thin-walled tubing are reduced.

Figure 3:
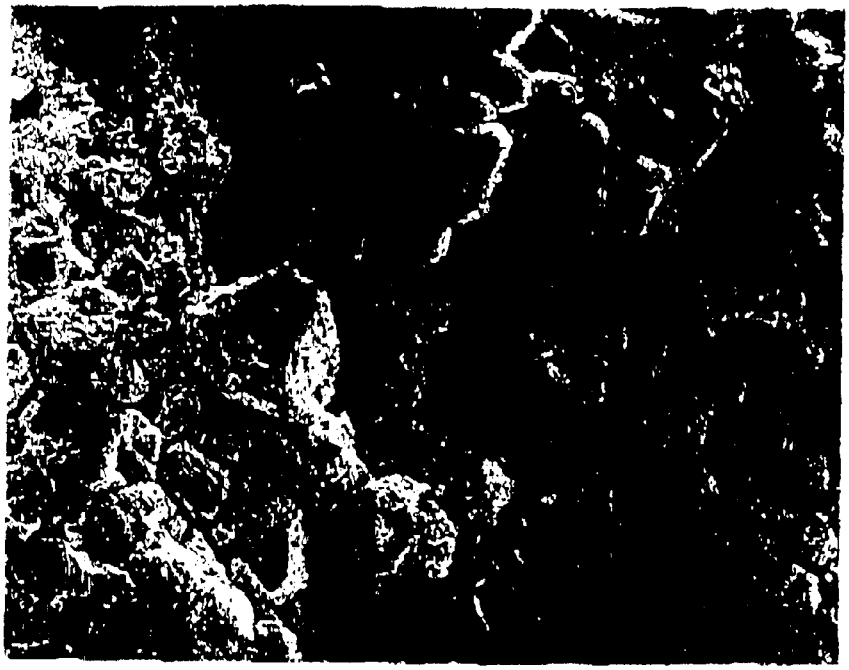
FIG. 3 is a micrograph showing the intergranular corrosion pattern of a prior art alloy.
Figure 4:
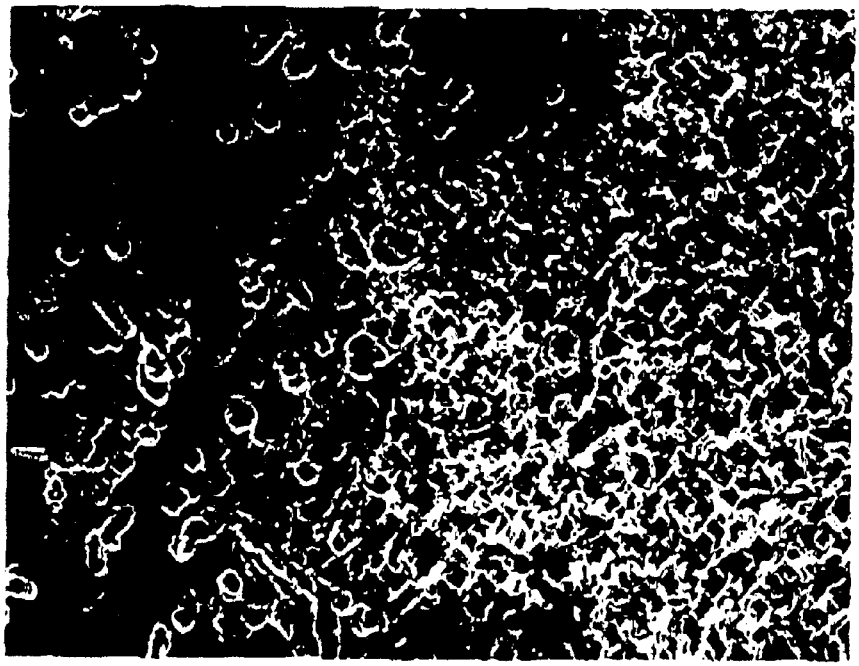
FIG. 4 is a micrograph showing homogenous corrosion of an alloy according to the invention.

The contrast between the homogenous corrosion of the chromium- and titanium-containing aluminum alloy and the intergranular corrosion of the zinc- and titanium-containing aluminum alloy is further illustrated in FIGS. 3 and 4. FIG. 3 is a micrograph of the zinc- and titanium-containing aluminum alloy showing severe intergranular corrosion. In contrast, FIG. 4, illustrating the chromium- and titanium-containing aluminum alloy, exhibits a much more homogenous corrosion. These micrographs confirm that the use of chromium with titanium as well as the ratios of manganese and iron unexpectedly provide a significantly improved aluminum alloy in terms of corrosion resistance, particularly intergranular corrosion resistance.

In summary, the SWAAT testing and observations of the actual samples that were the tested clearly show that at least the control of the levels of zinc, chromium, and titanium is important in minimizing the extent of corrosion at the grain boundaries. High levels of zinc are harmful. The elements of chromium, and titanium on their own are insufficient to provide excellent corrosion resistance. However, amounts of chromium and titanium with impurity levels of zinc, e.g., less than 0.1% or less as detailed above produce an aluminum alloy having excellent corrosion resistance. As noted above, it is believed that this corrosion resistance is achieved by matching the electrolytic potential of the matrix and the grain boundary so that neither, particularly the grain boundary, are preferred sites for corrosion.

The invention also includes a method of making the aluminum alloy by controlling at least the levels of iron, manganese, chromium, zinc, and titanium to meet the ranges and ratios disclosed above. The method includes providing a molten aluminum or aluminum alloy bath and adjusting the composition as would be within the skill of the art so that the alloy when cast or solidified has the target composition.

Once the inventive alloy is cast, it can be processed conventionally to form any article that would require a need for one or more of corrosion resistance, brazeability, hot workability, and formability. A preferred application of the alloy is to make tubing, typically using extrusion as the hot working method. The tubing can be employed in heat exchanger applications wherein the tubing is assembled with other heat exchanger components and subjected to a brazing operation to secure the various heat exchanger components into one integral structure. The alloy of the invention is especially useful in these applications, since the alloy has good hot workability for the extrusion process, good formability for manufacturing operations such as expansion steps for the condenser assembly process, good brazeability for the brazing operation, and good corrosion resistance.

As such, an invention has been disclosed in terms of preferred embodiments thereof which fulfills each and every one of the objects of the present invention as set forth above and provides new and improved aluminum alloy, articles made from the alloy, and a method of producing and using aluminum alloy articles made from the aluminum alloy.

Of course, various changes, modifications and alterations from the teachings of the present invention may be contemplated by those skilled in the art without departing from the intended spirit and scope thereof. It is intended that the present invention only be limited by the terms of the appended claims.

Having thus described the invention, what is claimed is:

1. An aluminum alloy composition consisting essentially of, in weight percent:

between about 0.05 and 0.5% silicon;

an amount of iron between about 0.05% and up to 0.7%;

an amount of manganese up to about 2.0%;

up to about 0.10% magnesium;

up to about 0.10% nickel;

up to about 0.5% copper;

an alloying amount of chromium between about 0.03 and 0.50%;

between about 0.03 and 0.35% titanium;

with the balance aluminum and inevitable impurities, including zinc as an impurity element in an amount less than 0.06%; wherein the manganese to iron ratio is maintained between about 2.0 and about 6.0, and the amounts of chromium and titanium are controlled so that a ratio of chromium to titanium ranges between 0.25 and 2.0.

2. The alloy of claim 1, wherein the titanium amount ranges between about 0.06 and 0.30%, and the chromium amount ranges between about 0.06 and 0.30%.

3. The alloy of claim 2, wherein the titanium amount ranges between about 0.08 and 0.25%, and the chromium amount ranges between about 0.08 and 0.25%.

4. The alloy of claim 1, wherein the ratio of chromium to titanium ranges between about 0.5 and 1.5.

5. An article made from the alloy of claim 1.

6. The article of claim 5, wherein the article is tubing.

7. In a heat exchanger having tubing brazed to fin stock, the improvement comprising the tubing being made of the alloy of claim 1.

8. An aluminum alloy composition consisting essentially of, in weight percent:

between about 0.05 and 0.5% silicon;

an amount of iron between about 0.10% and up to 0.50%;

an amount of manganese greater the 0.4 and up to about 1.0%;

up to about 0.10% magnesium;

up to about 0.10% nickel;

up to about 0.1% copper;

an alloying amount of chromium between about 0.06 and 0.30%;

between about 0.06 and 0.30% titanium;

with the balance aluminum and inevitable impurities, including zinc as an impurity element in an amount less than 0.06%; wherein the manganese to iron ratio is maintained between about 2.0 and about 6.0, and the amounts of chromium and titanium are controlled so that a ratio of chromium to titanium ranges between 0.25 and 2.0.

* * * * *